United States Patent [19]

Vartoukian et al.

[11] Patent Number: 4,552,081

[45] Date of Patent: Nov. 12, 1985

[54] SKELETAL FRAME SEWING MACHINE

[75] Inventors: Artin G. Vartoukian, Roselle Park, N.J.; Gregoire G. Moussaian, Freneuse, France

[73] Assignee: The Singer Company, Stamford, Conn.

[21] Appl. No.: 740,167

[22] Filed: Jun. 3, 1985

[51] Int. Cl.[4] ..... D05B 73/04

[52] U.S. Cl. ..... 112/258; 112/195

[58] Field of Search ..... 112/258, 259, 195, 194, 112/220

[56] References Cited

U.S. PATENT DOCUMENTS 3,467,041 9/1969 Greulich ..... 112/195 X
3,866,553 2/1975 Adams et al. ..... 112/258
4,193,361 3/1980 Johnson ..... 112/259
4,421,042 12/1983 Killinger ..... 112/259

FOREIGN PATENT DOCUMENTS 1481366 7/1977 United Kingdom ..... 112/259

*Primary Examiner*—Werner H. Schroeder
*Assistant Examiner*—Andrew M. Falik
*Attorney, Agent, or Firm*—Robert E. Smith; Edward L. Bell

[57] ABSTRACT

A skeletal frame sewing machine construction in which stitch forming instrumentalities supported on the skeletal frame are brought into cooperative relation by a combination of positioned adjustments of the instrumentalities on the skeletal frame and the influence of selective compensating forces developed between the skeletal frame and exterior casing parts.

6 Claims, 5 Drawing Figures

SKELETAL FRAME SEWING MACHINE

BACKGROUND OF THE INVENTION

The requirements of relative physical position and timed interrelated movement between cooperating stitch forming instrumentalities of a sewing machine are extremely critical. In conventional sewing machine construction utilizing an external frame in which the parts are assembled, the need for such critical relationships causes the imposition of severe limitation on the frame design to insure requisite rigidity and stability and requires costly and time consumming frame forming and machining operations for requisite tolerance control between the operative stitch forming instrumentalities.

In known skeletal frame sewing machine constructions, such as disclosed in U.S. Pat. Nos. 2,741,202, Apr. 10, 1956; 2,793,600, May 28, 1957; 2,946,302, July 26, 1950 and 3,420,200, Feb. 3, 1966, the external casing, when utilized, serves primarily as decorative cover with perhaps support for controls, illumination, indicia, and the like with result that the costly and time consumming manufacturing requirements are not reduced but rather are simply transferred from the external to the skeletal frame.

SUMMARY OF THE INVENTION

This invention relates to a novel and improved skeletal frame construction for a sewing machine which employs unique arrangement of stitch forming instrumentalities on the frame and novel interrelationship between the skeletal frame and external casing whereby the critical interrelationships between cooperating stitch forming instrumentalities may be attained without requiring costly forming or machining techniques for either the skeletal frame or the casing. As a result, an extremely cost effective sewing machine construction is provided which exhibits effective and reliable sewing characteristics. More particularly, critical stitch forming instrumentalities are not only carried by the skeletal frame of this invention with novel capacity for positional adjustment, but the skeletal frame and exterior casing parts are constructed and arranged so as to exert selective compensating forces therebetween in such a way as to offset tolerances that might otherwise adversely influence cooperative stitch formation.

DESCRIPTION OF THE DRAWINGS

With the above and additional objects and advantages in view as will hereinafter appear, this invention will now be described with reference to the accompanying drawings of a preferred embodiment in which.

DESCRIPTION OF THE INVENTION

Referring to the accompanying drawings, the sewing machine of this invention includes a skeletal frame indicated generally at 11 which carries all of the stitch forming instrumentalities and actuating mechanism therefor. Associated with the skeletal frame is an exterior casing which is divided generally along the vertical centerline of the sewing machine into a front casing half 12 and a rear casing half 13.

Figure 2:
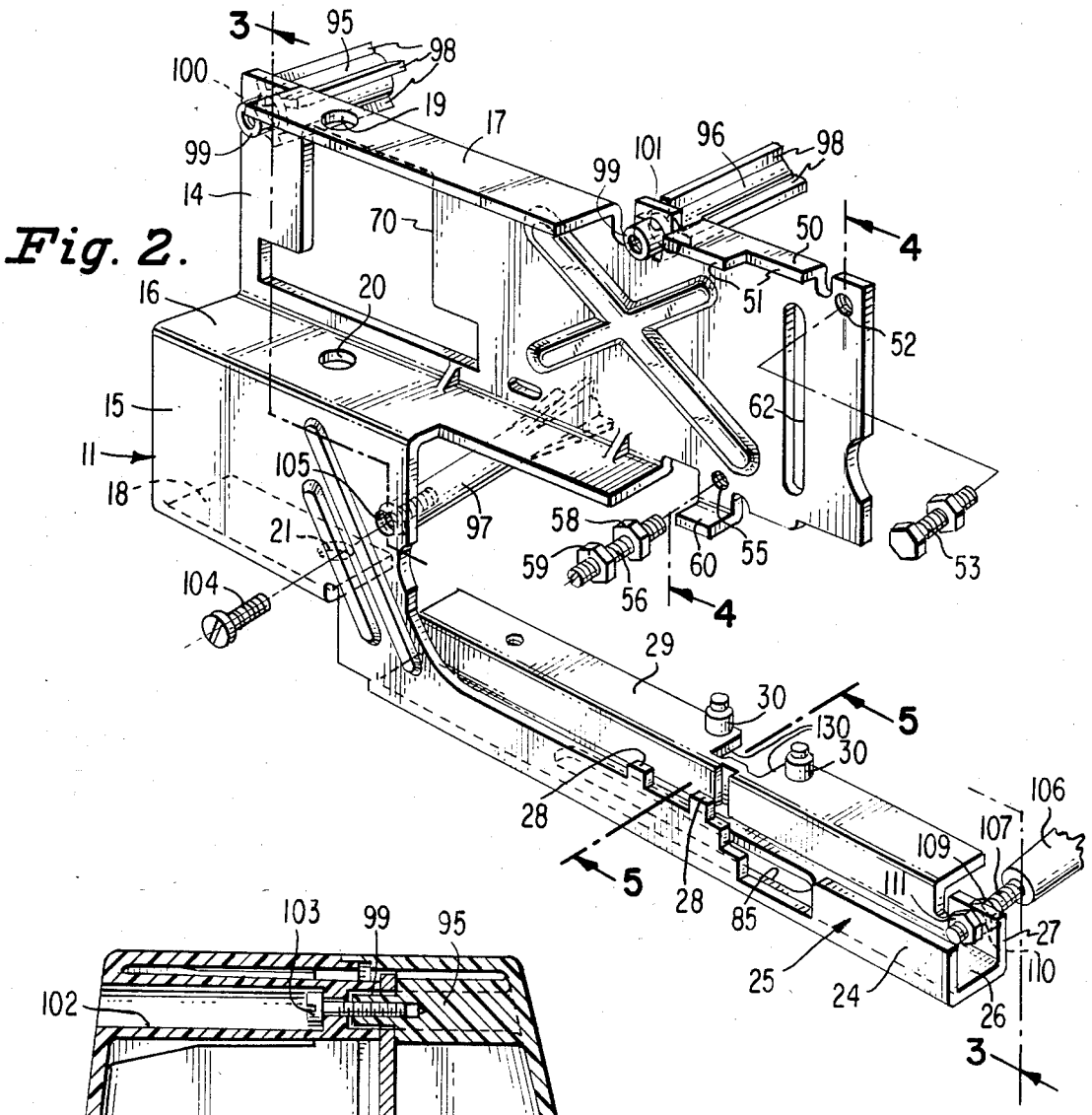
FIG. 2 is a perspective view of the skeletal frame with all operative parts removed therefrom but showing portions of the casing abutment means with the skeletal frame in engagement therewith.
Figure 3:
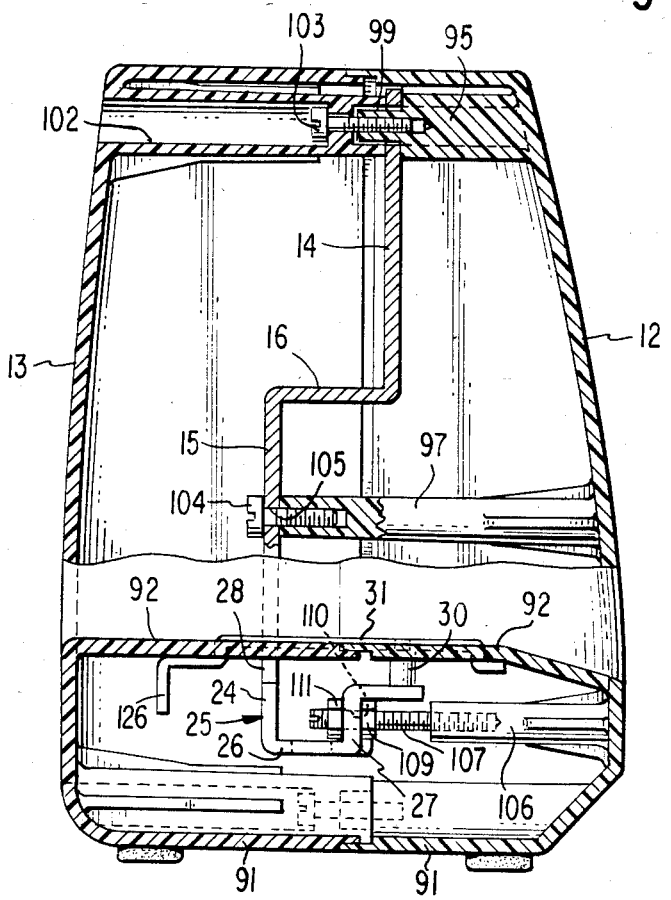
FIG. 3 is a vertical cross sectional view taken substantially along line 3—3 of FIG. 2 showing the skeletal frame and portions of the exterior casing including abutment means and fastening means maintaining the skeletal frame in engagement therewith.

As best illustrated in FIG. 2, the skeletal frame 11 is formed of an integral sheet metal stamping including an upper substantially planar vertical segment 14, and a lower substantially planar vertical segment 15 laterally offset and substantially parallel to the upper segment 15 by a horizontal segment 16 extending therebetween. A laterally offset flange 17 extending from the upper vertical segment, the horizontal segment 16 and a laterally offset flange 18 extending from the lower vertical segment are each formed with apertures 19, 20 and 21, respectively, the apertures being aligned to accommodate a main shaft 22 to which a handwheel 23 is fastened above the flange 17. The vertical frame segments 14 and 15 may be formed with appropriate indentations for strengthening and enhancing the rigidity of these segments.

Formed integrally with and extending from the lower vertical frame segment 15 is one vertical wall 24 of an upwardly open U-shaped shuttle race indicated generally at 25 and including a bottom wall 26 joined by a second vertical wall 27 parallel to the wall 24. The one vertical wall 24 of the shuttle race 25 is formed with spaced projections 28 while the second vertical wall 27 of the shuttle race is formed with an outwardly offset flange 29 from which rises spaced shouldered pins 30. As will be described in greater detail hereinbelow, the pins 30 and projections 28 provide support and location for a throat plate 31 and a work engaging feed dog 32.

Carried on the upper vertical segment 14 of the skeletal frame is a sewing head module bracket 40 on which is subassembled a work presser device 41, a needle thread take up 42, a needle thread tension device 43 and a needle bar 44 to which a thread carrying needle 45 is secured as by a clamp screw 46. U.S. Pat. No. 4,421,042, dated Dec. 20, 1983, of K. H. Killinger, which is incorporated herein by reference, discloses the details of construction of the sewing head module save for the novel manner in which the module is positioned and secured to the skeletal frame in accordance with this invention.

Figure 1:
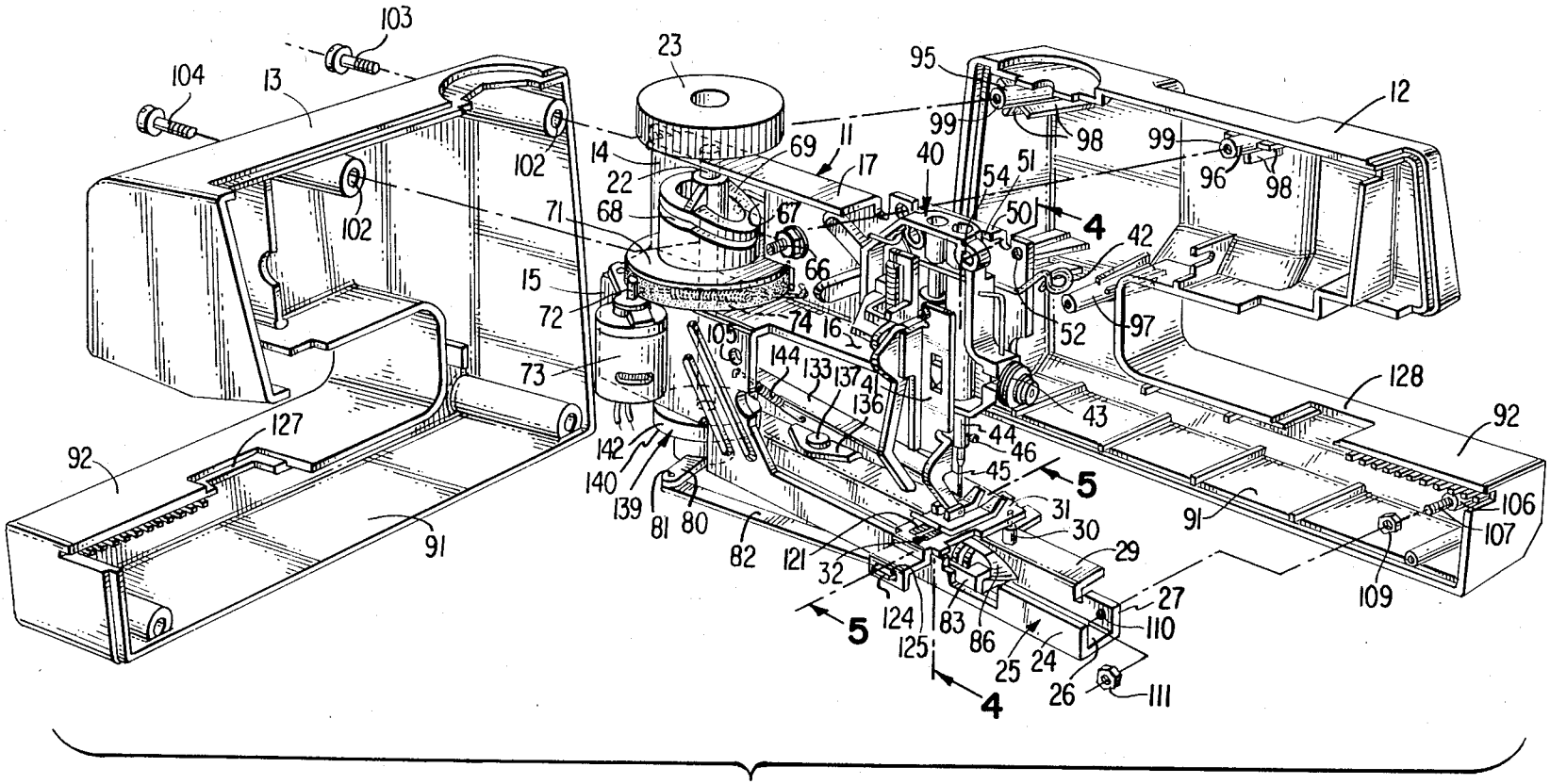
FIG. 1 is a perspective view of a skeletal frame sewing machine in accordance with this invention showing the operative parts assembled on the skeletal frame and the exterior casing detached therefrom.
Figure 4:
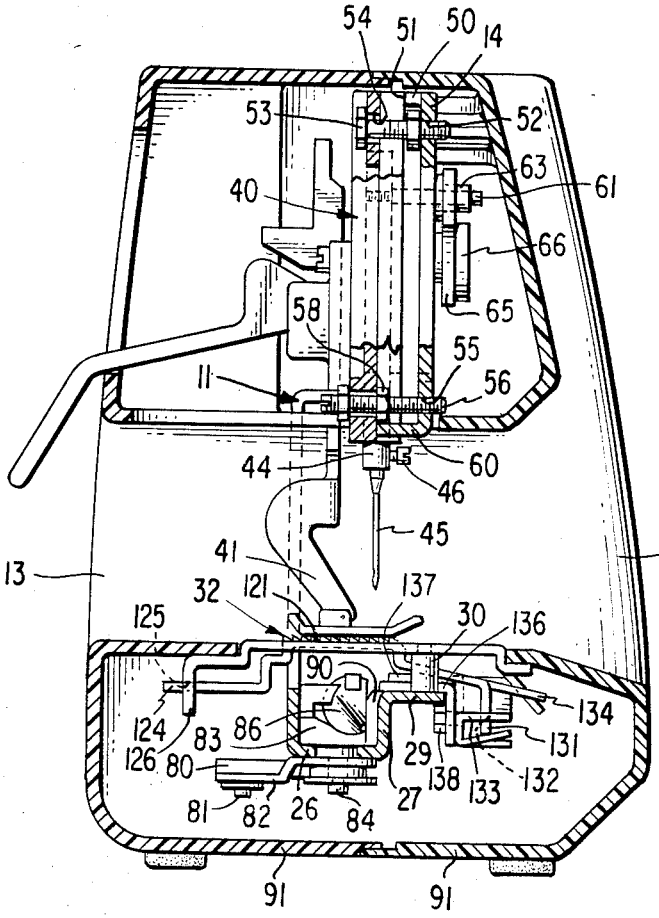
FIG. 4 is a cross sectional view taken substantially along line 4—4 in FIGS. 1 and 2 showing the means for securing the sewing head module to the skeletal frame.

As illustrated in FIGS. 1, 2 and 4, the upper vertical segment 14 of the skeletal frame is formed at the top with a laterally offset flange 50 of which the free extremity 51 is shaped complemental to the exterior shape of the top of the sewing head module 40. Closely adjacent to the flange 50, the vertical frame segment 14 is formed with a tapped hole 52 accommodating a fastening screw 53 which extends through a clearance hole 54 in the sewing head module. At the bottom, the upper vertical segment 14 of the skeletal frame is formed with a tapped hole 55 accommodating a threaded stud 56. A stop nut 58 which may be adjusted along the stud 56 engages the sewing head module which may be secured thereon by a clamp nut 59. By adjustment of the position of the stop nut 58 the inclination of the needle bar 44 of the sewing, head module relatively to the plane of the vertical segment 14 of the skeletal frame may be selected; and by virtue of the clearance between the hole 54 and the fastening screw 53, the angular orientation of the needle bar about the stud 56 may be adjusted. A lateral flange 60 on the frame adjacent the stud 56 may be provided to limit the extent of adjustment provided by the stop nut 58.

The needle bar 44 preferrably carries a lateral pin 61 projecting through a slot 62 in the vertical segment 14 of the frame and embraced by a sleeve 63 straddled by an elongated slot (not shown) in an actuating lever 65 pivoted as at 66 on the skeletal frame 11 and having a follower pin 67 tracking a groove 68 in a cam 69 fast on the main shaft 22. The vertical segment 14 of the frame 11 is preferrably formed with an opening 70 accommodating the cam 69 as well as a drive disk 71 which may be formed integral with the cam 69 and is engaged by the drive shaft 72 of an electric motor 73 biased by a spring 74 into driving relation against the drive disk.

Secured to the lower extremity of the main shaft 22 is a crank arm 80 pivoted at 81 to a connecting link 82 which is in turn connected to a shuttle carrier 83 slidable in the shuttle race 25. A pivot pin 84 connecting the link 82 to the shuttle carrier extends through a slot 85 in the bottom wall 26 of the shuttle race 25. A boat type shuttle 86 in the shuttle carrier 83 is reciprocated along the shuttle race by the crank arm 80 so as to move back and forth past a needle accommodating notch 90 formed in the second wall 27 of the shuttle race. Preferably, the notch 90 forms an aperture through the shuttle race bottom wall in which the thread carrying needle 45 is free to reciprocate.

The novel fastening means for the sewing head module described above provides a degree of adjustment for the path of endwise reciprocation of the needle facilitating alignment thereof with the notch 90 in the shuttle race. The interrelation of the skeletal frame 11 with the exterior casing 12, 13 which will now be described provides an additional degree of control over the cooperative interrelation between stitch forming instrumentalities.

The exterior casing halves 12 and 13 are preferrably of molded plastic construction with an exterior configuration dictated largely by aesthetic considerations. Preferably the casing halves when assembled, have interior dimensions sufficient to accommodate the skeletal frame with operative parts assembled thereon as illustrated in FIG. 1. In addition, each casing half 12 and 13 is formed with a horizontal base section 91 defining a support plane for the assembled sewing machine and with a horizontal work supporting section 92 substantially parallel to and above the base section.

The front casing half 12 is formed internally with three non-adjustable abutments 95, 96 and 97, against which the skeletal frame 11 is adapted to be located and supported above the casing base section. The abutments 95 and 96 are located adjacent the upper surface of the casing half 12 and may each take the form of fins 98 radiating from a central pilot protection 99. The skeletal frame upper vertical segment 14 is formed with apertures 100 and 101 to accommodate the pilot projections 99, while the rear casing half 13 is provided with counterbored sockets 102 accommodating fastening screws 103 threaded into the pilot projections 99 to secure the upper vertical segment 14 of the skeletal frame firmly to the exterior casing halves 12 and 13.

The abutment 97 is provided by an attenuated, preferably flexible, post extending from the front casing half 12 and secured to the lower vertical segment 15 of the skeletal frame 11 by a fastening screw 104 which passes through an aperture 105 in the segment 15 and is threaded into the abutment post 97.

The front casing half 12 is provided with a laterally adjustable abutment means engageable with the free extremity of the shuttle race 25. To this end the casing half 12 is formed with an internally threaded boss 106 accommodating a threaded stud 107. A stop nut 109 on the stud 107 provides the adjustable abutment against the wall 27 of the shuttle race. The stud 107 extends through an aperture 110 in the shuttle race wall 27 and a clamp nut 111 on the stud 107 serves to secure the shuttle race wall securely against the stop nut 109.

By adjustment of the abutment stop nut 109, the inclination of the shuttle race 25 and lower vertical frame segment 13 with respect to the plane of the upper segment 12 as defined by the fixed abutments 95 and 96 may be effected and by this arrangement tolerance veriations in the skeletal frame 11 and in the casing halves 12 and 13 may be overcome. Using the adjustments described earlier for securing the sewing head module together with the shuttle race inclination adjustment, it is possible to attain alignment of the thread carrying needle 45 with the shuttle race notch 90 sufficient for stitch forming cooperation between the needle and shuttle dispite wide tolerance variations in the parts. As a result, a dependable and effective stitch forming mechanism is provided in a highly cost effective manner.

For feeding work fabric relatively to the path of needle reciprocation in the formation of stitches, the feed dog 32 which may be formed of sheet metal has a raised roughened work engaging central portion 121 which extends through slots 122 in the throat plate 31. The feed dog 32 is formed with a rearwardly extending tang 124 guided in an aperture 125 formed in a downturned flange 126 on the throat plate 31.

Figure 5:
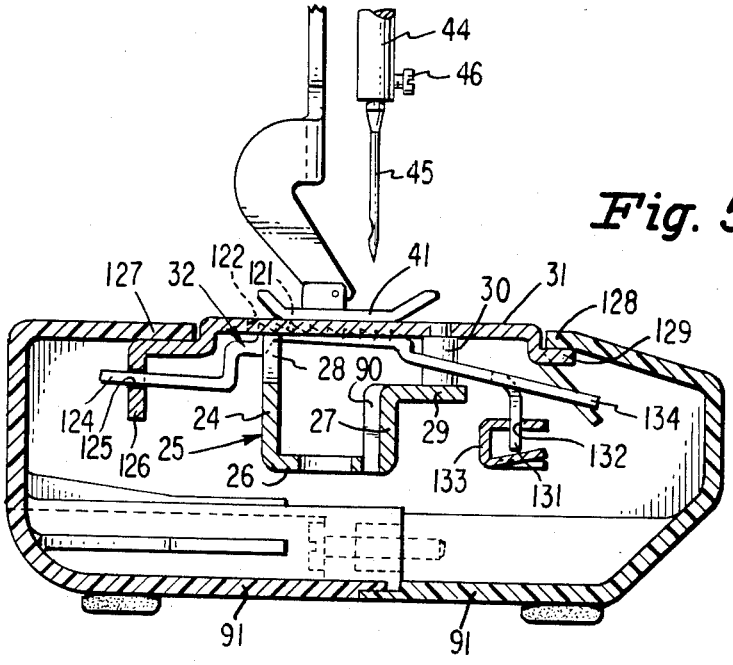
FIG. 5 is a cross sectional view taken substantially along line 5—5 of FIGS. 1 or 2 showing the work feed dog and throat plate support in the assembled sewing machine embodying this invention.

The throat plate 31 is supported from beneath by the projections 28 and the shoulders of the pins 30 on the shuttle race and the throat plate is constrained on these projections 28 and pins 30 as shown in FIG. 5 by a portion 127 of the work supporting section 92 of the rear casing 13 which overlies the throat plate flange 126 and by a portion 128 of the work supporting section 92 of the front casing 12 which overlies throat plate projections 129. The feed dog 32 is constrained laterally between the projections 28 between the pins 30, and is constrained vertically between the shuttle race 25 and the throat plate 31.

The shuttle race flange 29 between the pins 30 is formed with a recess 130 accommodating a downturned finger 131 formed on the feed dog 32. The finger 131 extends into an aperture 132 in a feed actuating lever 133 carried alongside the shuttle race so as to transmit movements from the lever 133 to the feed dog laterally across the shuttle race. Forwardly projecting fingers 134 on the feed dog overlie the lever 133 and transmit vertical movement from the lever 133 to the feed dog.

A universal pivotal connection for the lever 133 with respect to the skeletal frame 11 is provided by an angle bracket 136 which is pivoted to the shuttle race flange 29 by the vertical pivot pin 137 and on which the lever 133 is pivoted by a horizontal pivot pin (not shown). A feed actuating cam 139 on the main shaft is formed with a feed lift cam surface 140 and a feed advance-and-return actuating cam surface 142 both tracked by follower surfaces on the lever 133. A spring 144 maintains the lever 133 in tracking relation with the both the feed lift and feed advance and return actuating surfaces of the cam 139.

We claim:

1. A sewing machine comprising a skeletal frame formed of an integral sheet metal stamping, said skeletal frame including two vertical substantially planar segments laterally spaced by a horizontal segment offset between said vertical segments, said vertical segments each being formed with a laterally offset flange spaced from said horizontal segment; a main shaft journalled in aligned bearing apertures formed in said horizontal segment and in each of said offset flanges; a sewing head module including a work presser, a needle carrying bar, a needle thread take-up, and a needle thread tensioning device; means for supporting said sewing head module on one of said planar vertical skeletal frame segments; an upwardly open U-shaped shaped shuttle race formed integrally on the other of said substantially planar vertical segments of said skeletal frame; a shuttle carrier reciprocable in said shuttle race; a work engaging feed dog; means locating and supporting said feed dog on said skeletal frame spanning said shuttle race; rotary actuators on said mainshaft; and means carried on said skeletal frame and responsive to said rotary actuators for actuating said needle carrying bar, said take-up, said shuttle carrier and said work feed dog in the formation of lock stitches.

2. A sewing machine as set forth in claim 1 in which said means for supporting the sewing head module on one of said planar vertical frame segments includes a first securing means providing for selective setting of the inclination of the needle carrying bar with respect to the planar vertical frame segment, and a second securing means providing for angular adjustment of the sewing head module about said first securing means.

3. A sewing machine as set forth in claim 2 in which said one of said planar vertical frame on which said sewing head module is supported is formed with a laterally extending abutment spaced from said first securing means and engaging said sewing head module, in which said first securing means comprises a threaded stud extending laterally from said planar vertical frame segment and a sewing head module engaging stop threadedly engaging said stud, and in which said second securing means comprises a headed clamp screw threadedly engaging said one planar vertical frame segment adjacent said abutment and traversing a clearance aperture formed through said sewing head module.

4. A sewing machine as set forth in claim 1 in combination with a molded plastic casing, spaced coplanar abutment means formed on said casing engageable with that vertical planar skeletal frame segment supporting said sewing head module, abutment means formed on said casing engageable with the other of said vertical planar skeletal frame segments, a laterally adjustable abutment means on said casing engageable with said shuttle race, and means for maintaining said skeletal frame in engagement with each of said abutment means for selectively influencing inclination of said shuttle race relatively to the plane of said skeletal frame vertical segment supporting said sewing head module.

5. A sewing machine as set forth in claim 4 in which said molded plastic casing includes two substantially symetrical halves, said abutment means being carried on one of said casing halves, said means for maintaining said skeletal frame in engagement with said abutment means including skeletal frame engaging surfaces formed on the other of said casing halves, and fastening means for securing said casing halves together.

6. A sewing machine as set forth in claim 1 in combination with a molded plastic casing formed with a base defining a plane of support for said casing on a table top or the like, fastening means securing said skeletal frame within said casing in spaced relation above said plane of support, in which said means locating and supporting said work feed dog includes a throat plate formed with feed dog accommodating slots, locating and supporting surfaces formed on said shuttle race engaging the undersurface of said throat plate and locating and supporting surface formed on said casing engaging the upper surface of said throat plate.

* * * * *